US007196470B2

(12) United States Patent
Yoo et al.

(10) Patent No.: US 7,196,470 B2
(45) Date of Patent: Mar. 27, 2007

(54) PLASMA DISPLAY PANEL HAVING SUSTAIN ELECTRODE ARRANGEMENT

(75) Inventors: Hun-Suk Yoo, Cheonan-si (KR); Won-Ju Yi, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/071,733

(22) Filed: Mar. 4, 2005

(65) Prior Publication Data

US 2005/0242723 A1 Nov. 3, 2005

(30) Foreign Application Priority Data

May 1, 2004 (KR) ..... 10-2004-0030840

(51) Int. Cl.
*H01J 17/49* (2006.01)

(52) U.S. Cl. ..... 313/582; 313/583

(58) Field of Classification Search ..... 313/582
See application file for complete search history.

(56) References Cited

U.S. PATENT DOCUMENTS

| | | | | |
|---|---|---|---|---|
| 5,004,950 | A * | 4/1991 | Lee | 313/582 |
| 5,371,437 | A * | 12/1994 | Amano | 313/584 |
| 5,541,618 | A | 7/1996 | Shinoda | 345/60 |
| 5,661,500 | A | 8/1997 | Shinoda et al. | 345/60 |
| 5,663,741 | A | 9/1997 | Kanazawa | 345/66 |
| 5,674,553 | A | 10/1997 | Shinoda et al. | 427/68 |
| 5,724,054 | A | 3/1998 | Shinoda | 345/60 |
| 5,744,909 | A * | 4/1998 | Amano | 313/585 |
| 5,786,794 | A | 7/1998 | Kishi et al. | 345/60 |
| 5,952,782 | A | 9/1999 | Nanto | 313/584 |
| RE37,444 | E | 11/2001 | Kanazawa | 345/67 |
| 6,414,435 | B1 * | 7/2002 | Akiba | 313/584 |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Nimeshkumar D. Patel
*Assistant Examiner*—Natalie K. Walford
(74) *Attorney, Agent, or Firm*—Robert E. Bushnell, Esq.

(57) ABSTRACT

A plasma display panel. The plasma display panel includes a first substrate made of a transparent material, a second substrate opposite to the first substrate, a first barrier rib being arranged between the first substrate and the second substrate, defining discharge cells together with the first and second substrates, and being made of a dielectric material, upper discharge electrodes being arranged within the first barrier rib and surrounding the discharge cells, lower discharge electrodes being arranged within the first barrier rib, separated from the upper discharge electrodes by a predetermined gap, and respectively being vertically symmetrical with the upper discharge electrodes, and a phosphor layer being arranged in the discharge cells.

29 Claims, 5 Drawing Sheets

U.S. PATENT DOCUMENTS

| | | | | |
|---|---|---|---|---|
| 6,548,962 | B1 * | 4/2003 | Shiokawa et al. | 313/584 |
| 6,630,916 | B1 | 10/2003 | Shinoda | 345/60 |
| 6,707,436 | B2 | 3/2004 | Setoguchi et al. | 345/60 |
| 6,873,105 | B2 * | 3/2005 | Akiba | 313/585 |
| 6,903,711 | B2 * | 6/2005 | Akiba | 313/585 |
| 2005/0116646 | A1 * | 6/2005 | Yoo et al. | 313/582 |
| 2005/0242722 | A1 * | 11/2005 | Yoo et al. | 313/582 |
| 2005/0258748 | A1 * | 11/2005 | Kang et al. | 313/582 |
| 2005/0264198 | A1 * | 12/2005 | Woo et al. | 313/582 |
| 2006/0125395 | A1 * | 6/2006 | Kang | 313/582 |
| 2006/0238123 | A1 * | 10/2006 | Kang | 313/582 |
| 2006/0267869 | A1 * | 11/2006 | Kwon | 345/60 |

FOREIGN PATENT DOCUMENTS

| | | | |
|---|---|---|---|
| JP | 06130913 | A * | 5/1994 |
| JP | 2845183 | | 10/1998 |
| JP | 2917279 | | 4/1999 |
| JP | 2000133144 | A * | 5/2000 |
| JP | 2001-043804 | | 2/2001 |
| JP | 2001-325888 | | 11/2001 |

* cited by examiner

PLASMA DISPLAY PANEL HAVING SUSTAIN ELECTRODE ARRANGEMENT

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 1 May 2004 and thereby duly assigned Serial No. 2004-30840.

BACKGROUND OF THE INVENTION

1. Field of the Invention

The present invention relates to a design for a plasma display panel (PDP) capable of realizing an image using a gas discharge.

2. Description of the Related Art

A plasma display panel (PDP) has a large screen and excellent characteristics such as high picture-quality, ultra-slim size, light-weight, and wide viewing angle. The PDP can be manufactured in a simpler manner than other flat panel display devices, and the size of the PDP can be easily increased. Thus, the PDP has been important as a next-generation flat panel display device.

PDPs are categorized into DC PDPs, AC PDPs, and hybrid PDPs depending on an applied discharge voltage. PDPs are also categorized into discharge PDPs and surface discharge PDPs depending on a discharge structure. Recently, the AC PDP having an AC, three-electrode, surface-discharge structure has been widely used.

However, PDPs suffer from the problem in that the visible light must travel through a front substrate to be seen by the viewer. Because the electrodes, a dielectric layer and a protective layer are found in the front substrate, a large percentage of the visible light gets absorbed before it can be seen. As a result, the emission efficiency is low. Also, when displaying an image for a long time, the ions in the plasma tend to sputter the phosphor layers, etching in a permanent image into the display. What is needed is an improved design for a PDP that improves on emission efficiency and reduces the image burn in effect.

SUMMARY OF THE INVENTION

It is therefore an object of the present invention to provide an improved design for a PDP.

It is also an object of the present invention to provide a design for a PDP that improves on the emission efficiency.

It is further an object of the present invention to provide a design for a PDP that results in less image burn in.

It is yet another object of the present invention to provide a design for a PDP that improves discharge stability.

These and other objects may be achieved by a plasma display panel that includes a first substrate made of a transparent material, a second substrate opposite to the first substrate, a first barrier rib being located between the first substrate and the second substrate defining discharge cells together with the first and second substrates, and being made of a dielectric material, upper discharge electrodes being located in the first barrier rib and surrounding the discharge cells, lower discharge electrodes being located in the first barrier rib, separated from the upper discharge electrodes by a predetermined gap, and respectively being vertically symmetrical with the upper discharge electrodes, and a phosphor layer located in the discharge cells.

The upper discharge electrodes may include upper discharge portions surrounding each of the discharge cells and upper connection portions connecting the upper discharge portions to one another, and the lower discharge electrodes may include lower discharge portions surrounding each of the discharge cells and respectivelybeing vertically symmetrical with the upper discharge portions and lower connection portions connecting the lower discharge portions to one another. The upper discharge electrodes may extend in one direction, and the lower discharge electrodes may extend along a direction perpendicular to the direction in which the upper discharge electrodes extend.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate same or similar components, wherein.

DETAILED DESCRIPTION OF THE INVENTION

Figure 1:
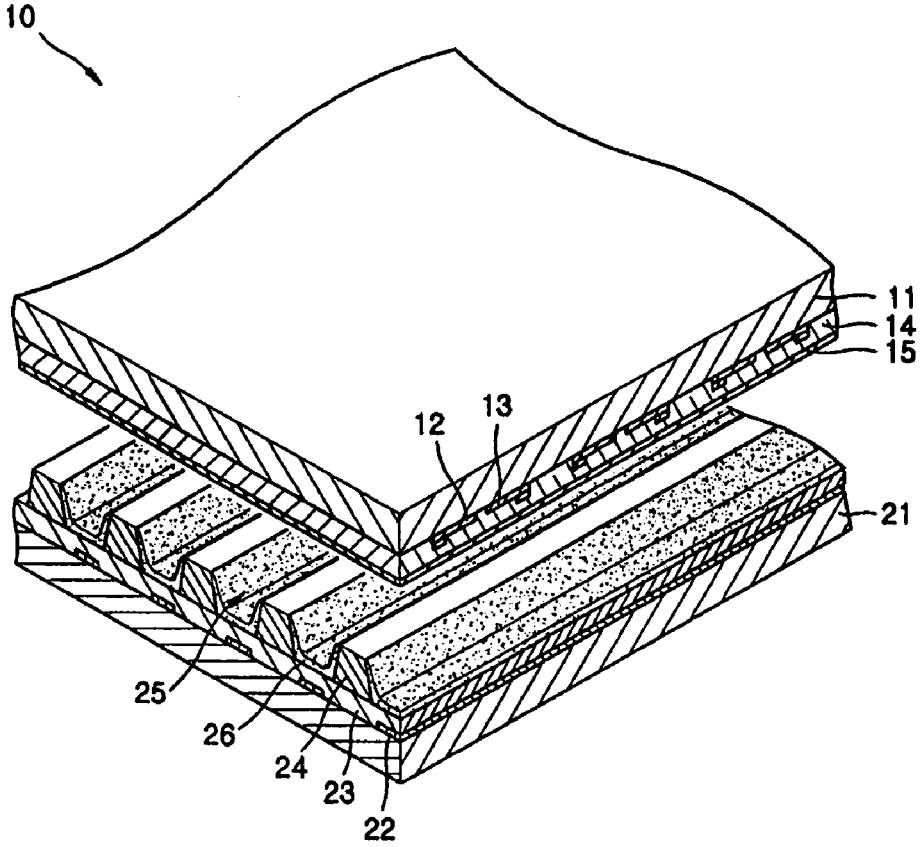
FIG. 1 (Prior Art)
FIG. 1 is a partly exploded perspective view of a plasma display panel (PDP)

Turning now to the figures, FIG. 1 illustrates an AC, three-electrode, surface-discharge PDP 10. The PDP 10 of FIG. 1 includes a first substrate 11 and a second substrate 21 opposite the first substrate 11. Common electrodes 12 and scan electrodes 13 forming a discharge gap with the common electrodes 12 are formed on a lower surface of the first substrate 11. The common electrodes 12 and the scan electrodes 13 are buried by a first dielectric layer 14. A protective layer 15 is formed on a lower surface of the first dielectric layer 14.

Address electrodes 22 are formed on an upper surface of the second substrate 21 to overlap with the common electrodes 12 and the scan electrodes 13. The address electrodes are buried by a second dielectric layer 23. Barrier walls 24 are formed on an upper side of the second dielectric layer 23 to be separated from one another by a predetermined gap so that discharge spaces 25 are partitioned off. A phosphor layer 26 is formed in each of the discharge spaces 25, and a discharge gas is sealed in the discharge spaces 25.

In the discharge spaces 25 of PDP 10, ultraviolet rays are emitted from plasma generated by discharge. These ultraviolet rays excite the phosphor layer 26, and visible light is emitted from the excited phosphor layer 26 so that a visible image is displayed.

However, due to a structure in which the electrodes 12 and 13, the first dielectric layer 14 and the protective layer 15 are sequentially formed on the lower surface of the first substrate 11, approximately 40% visible light emitted from the phosphor layer 26 is absorbed, which prevents improvement of the emission efficiency. Furthermore, when displaying the same image for a long time, charged particles of the discharge gas ion-sputter the phosphor layer 26 by an electric field, which results in the formation of a permanent image forming and thus reducing the life-span of the PDP.

Figure 2:
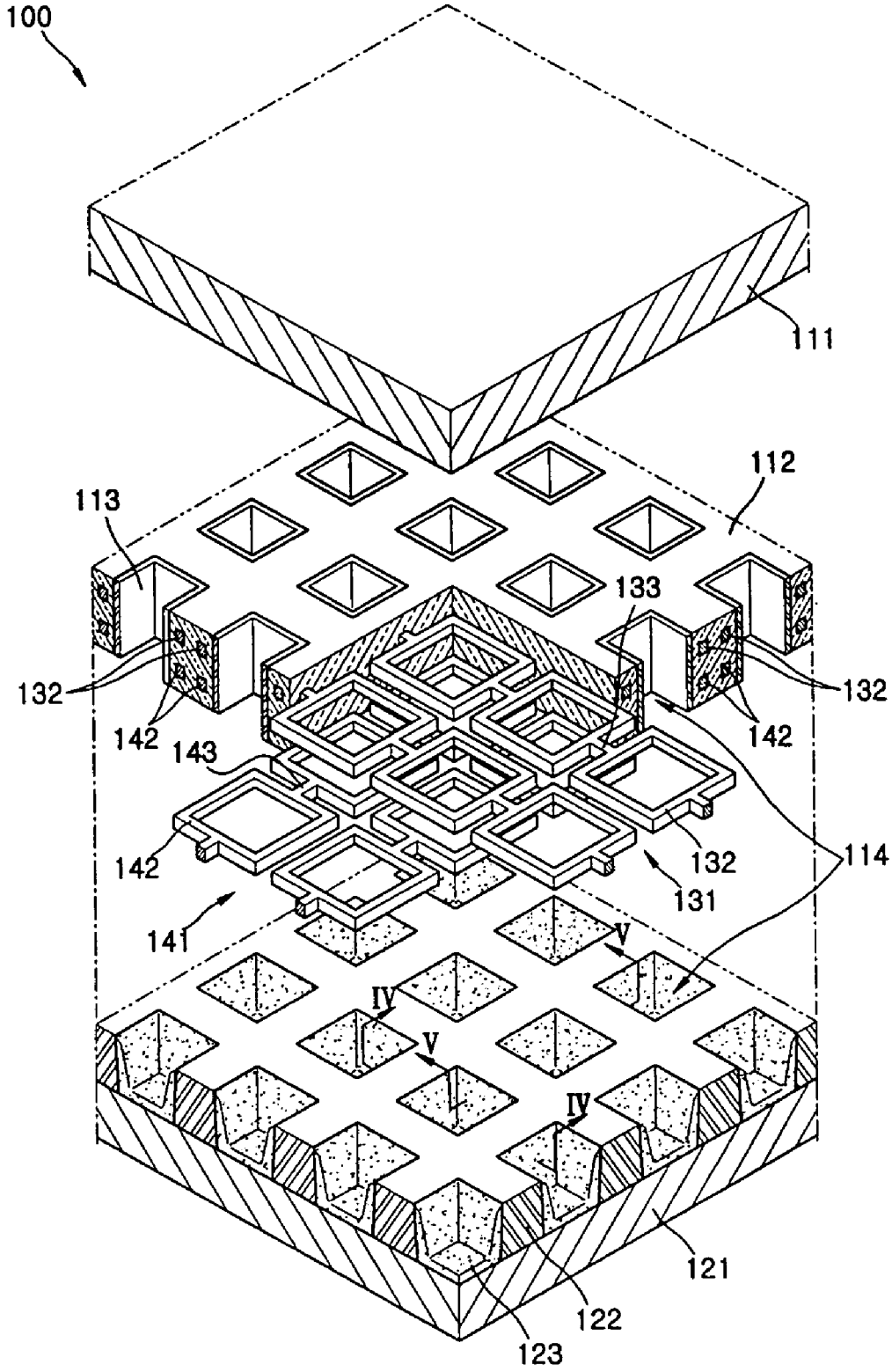
FIG. 2 is a partly exploded perspective view of a PDP according to an embodiment of the present invention.

Turning now to FIGS. 2 through 5, FIGS. 2 through 5 show a plasma display panel (PDP) 100 according to an embodiment of the present invention. Referring to FIG. 2, a PDP 100 includes a first substrate 111 and a second substrate 121 opposite to the first substrate 111. The first substrate 111 and the second substrate 121 are made of a transparent material such as glass. In particular, since an image is displayed through the first substrate 111, preferably, the first substrate 111 has a high transmissivity.

A first barrier rib 112 and a second barrier rib 122 are formed between the first substrate 111 and the second substrate 121 in the form of a predetermined pattern. In other words, as shown in FIG. 2, the first barrier rib 112 and the second barrier rib 122 are closed-type barrier ribs having a matrix shape of rectangular cross-sections. A lower side of the first barrier rib 112 corresponds to an upper side of the second barrier rib 122 so that a space defined by the first barrier rib 112 corresponds to a space defined by the second barrier rib 122.

However, the first barrier rib 112 and the second barrier rib 122 may be barrier ribs having a variety of patterns, for example, closed-type barrier ribs such as waffle or delta, or closed-type barrier ribs having cross-sections of circular shapes or elliptical shapes or polygonal shapes such as triangular or pentagonal shapes as well as rectangular shapes. In addition, the first barrier rib 112 may be a closed-type barrier rib, and the second barrier rib 122 may be an open-type barrier rib such as stripes.

The first barrier rib 112 and the second barrier rib 122 divide the space between the two substrates into a plurality of discharge cells. Each discharge cell 114 corresponds to either a red subpixel, a green subpixel, and a blue subpixel, each constituting a unit pixel, so as to realize a color image, together with the first and second substrates 111 and 121. The barrier ribs 112 and 122 also serve to prevent discharge errors caused by optical cross-talk between the discharge cells 114. As shown in FIG. 2, the first barrier rib 112 and the second barrier rib 122 may be separate elements or formed of the same material and a single body.

A phosphor layer 123 is excited by ultraviolet rays generated during a sustain-discharge causing visible light to be emitted. The phosphor layer 123 is located in each discharge cell 114. As shown in FIG. 2, the phosphor layer 123 is formed in a space defined by the second barrier rib 122, that is, on an upper surface of the second substrate 121 and on a side surface of the second barrier rib 122.

The phosphor layer 123 includes phosphor, which is excited by ultraviolet rays generated during a discharge. When excited, the phosphor layer 123 emits red, green, and blue visible light depending on the color of phosphor layer deposited in the discharge cell. For example, a red phosphor layer formed in a discharge cell corresponding to a red subpixel includes phosphor such as $Y(V,P)O_4$:Eu, a green phosphor layer formed in a discharge cell corresponding to a green subpixel includes phosphor such as $Zn_2SiO_4$:Mn and $YBO_3$:Tb, and a blue phosphor layer formed in a discharge cell corresponding to a blue subpixel includes phosphor such as BAM:Eu.

The phosphor layer 123 is formed in the space defined by the second barrier rib 122, and thus is separated by a gap from a main area of the first barrier rib 112 where a plasma discharge occurs. By designing the PDP with the plasma discharge area separate from where the phosphor layer is located, the phosphor layer 123 can be prevented from being ion-sputtered by charged particles of the plasma. This results in an extended life-span of the PDP 100 and prevents the formation of a permanent image, even when the same image is realized for a long time.

A discharge gas is sealed in the discharge cell 114 in which the phosphor layer 123 is located. Xe, Ne, or the like, and a mixed gas thereof may be used as the discharge gas.

Meanwhile, upper discharge electrodes 131 and lower discharge electrodes 141 are located 12 within the first barrier rib 112 between the two substrates. First barrier rib 112 partitions off the discharge cells 114 together with the second barrier rib 122, in a vertical direction. The upper discharge electrodes 131 and the lower discharge electrodes 141 overlap each other and cause a discharge in the discharge cells 114. Here, the upper discharge electrodes 131 are located on an upper side of first barrier rib 112 close to the first substrate 111, and the lower discharge electrodes 141 are located on a lower side of the first barrier rib 112 and are closer to the second substrate 121 than the upper discharge electrodes 131. The upper discharge electrodes 131 and the lower discharge electrodes 141, respectively, may be made of a conductive metal such as aluminum, copper, or silver. Since the metallic electrodes have a lower resistance than electrodes made of indium tin oxide (ITO), a discharge response speed can be faster than PDPs that use ITO electrodes.

The first barrier rib 112, formed around both the upper discharge electrodes 131 and the lower discharge electrodes 141, is made of a dielectric material. By having the first barrier rib 112 made out of a dielectric material, electricity can be prevented from flowing directly between the upper discharge electrodes 131 and the lower discharge electrodes 141. Also, by using a dielectric material for the first barrier rib 112, the upper discharge electrodes 131 and the lower discharge electrodes 141 can be prevented from being damaged by direct collision with charged particles of the plasma. Also, by forming the first barrier ribs 112 of a dielectric material, charged particles can be induced so that wall charges can easily accumulate on the first barrier ribs 112. The dielectric material used in forming the first barrier rib 112 may be PbO, $B_2O_3$, or $SiO_2$.

An MgO layer 113 having a predetermined thickness is further formed on a side surface of the first barrier rib 112. As such, owing to the MgO layer 113, the charged particles generated during a discharge can be prevented from directly colliding with the first barrier rib 112. Thus, the first barrier rib 112 can be prevented from being damaged by ion sputtering of the charged particles generated in the plasma. In addition, when the charged particles collide with the MgO layer 113, secondary electrons, which contribute to a discharge, can be emitted from the MgO layer 113 so that low driving voltage can be performed and an emission efficiency can be increased.

The upper discharge electrodes 131 and the lower discharge electrodes 141, which are located in the first barrier rib 112 in the above manner, will now be described in greater detail. The upper discharge electrodes 131 are located in an upper side portion of the first barrier rib 112 and are separated from each other by a predetermined gap and extend in one direction. As shown in FIG. 2, one upper discharge electrode 131 surrounds four sides of each discharge cell 114 arranged along the direction in which the upper discharge electrodes 131 extend. In other words, the upper discharge electrodes 131 arranged in one line includes upper discharge portions 132 which surround four sides of each discharge cell 114 and contribute to a discharge, and upper connection portions 133 which connect together the upper discharge portions 132.

In this case, the upper discharge portions 132 are formed to have a predetermined width in the form of a rectangular band (e.g. a rectangular frame or rectangular rim), respectively located in the first barrier rib 112 and thus surround four sides of each discharge cell 114. In addition, preferably, the upper connection portions 133 connecting together the upper discharge portions 132 are formed to have a minimum width, so as to minimize an effect on a discharge. The width of each upper connection portion 133 is approximately the same as the width of each upper discharge portion 132, but the width of the upper connection portion 133 may be smaller than the width of the upper discharge portion 132.

The upper discharge electrodes 131 are separated from one another by a predetermined gap along a direction perpendicular to the direction in which the upper discharge electrodes 131 extend. As such, the spaces between the upper discharge portions 132 are separated from one another by a predetermined gap. The separated portions of the upper discharge portions 132 form one group and are located together in one first barrier rib 112 formed along the direction in which the upper discharge electrodes 131 extend.

The lower discharge electrodes 141 located below the upper discharge electrodes 131 are separated from one another by a predetermined gap and respectively extend in a direction perpendicular to the upper discharge electrodes 131. As shown in FIG. 2, the lower discharge electrodes 141, like the upper discharge electrodes 131, have a structure in which one lower discharge electrode 141 surrounds four sides of each discharge cell 114 arranged along the direction in which the lower discharge electrodes 141 extend. As such, the lower discharge electrodes 141 arranged in one line includes lower discharge portions 142 which surround four sides of each discharge cell 114 and contribute to a discharge, and lower connection portions 143 which connect together the lower discharge portions 142.

In this case, the lower discharge portions 142 are formed to a predetermined width in the form of a rectangular band, respectively located in the first barrier rib 112 and thus surround four sides of each discharge cell 114. Like in the upper connection portions 133, preferably, the width of each lower connection portion 143 is approximately the same as the width of each lower discharge portion 142, but the width of the lower connection portion 143 may instead be smaller than the width of the lower discharge portion 142.

The lower discharge electrodes 141 are separated from one another by a predetermined gap along a direction perpendicular to the direction in which the lower discharge electrodes 141 extend. The separated portions of the lower discharge portions 142 form one group and are located together in one first barrier rib 112 formed along the direction in which the lower discharge electrodes 141 extend.

Figure 3:
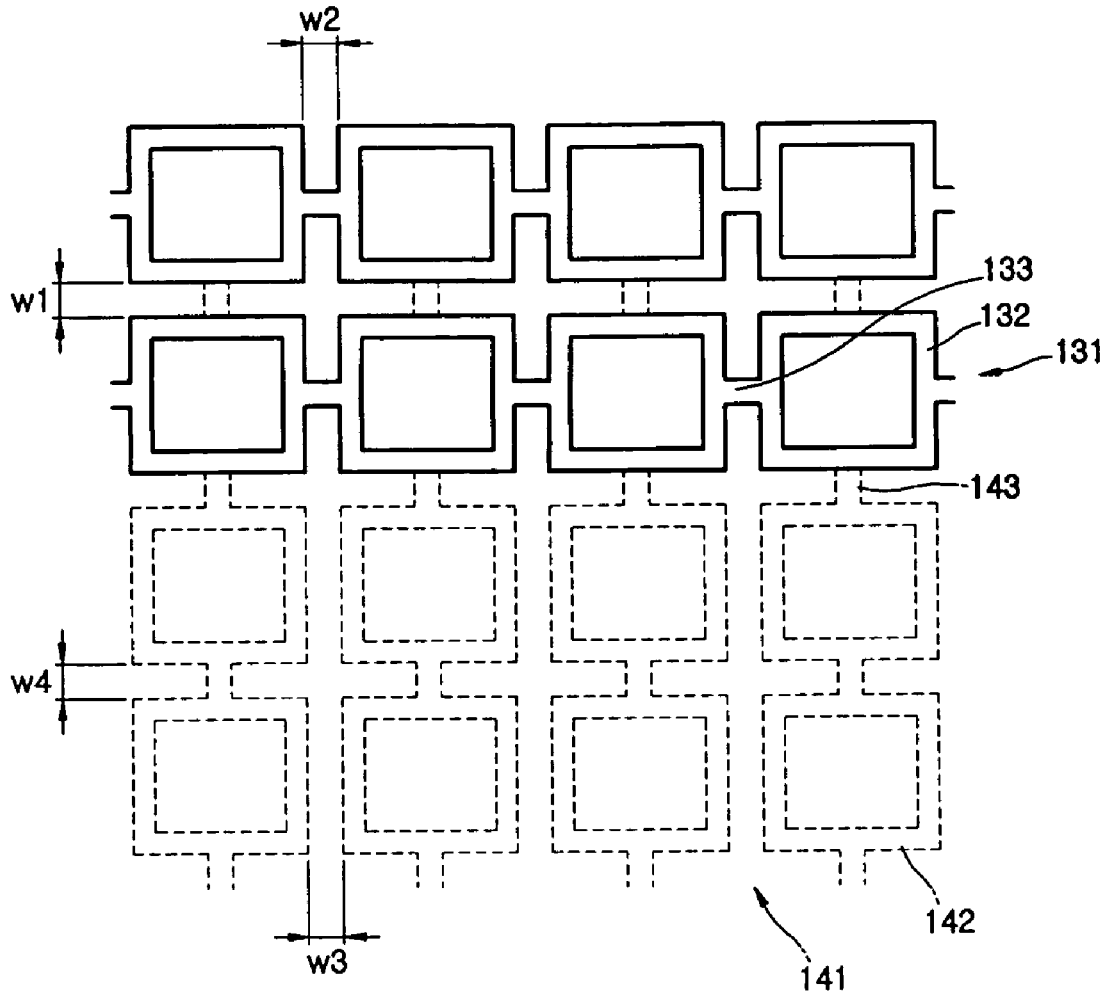
FIG. 3 is a plane view of the arrangement of upper discharge electrodes and lower discharge electrodes shown in FIG. 2.
Figure 4:
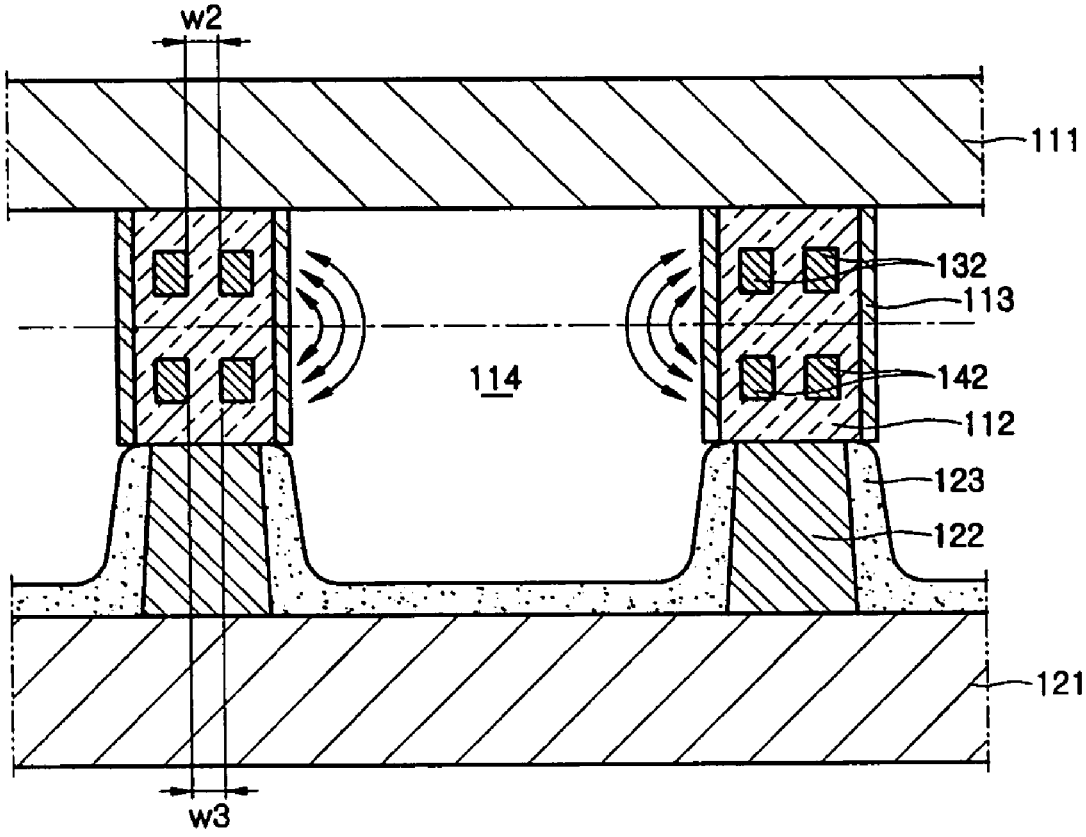
FIG. 4 is a cross-sectional view taken along line IV—IV of FIG. 2.
Figure 5:
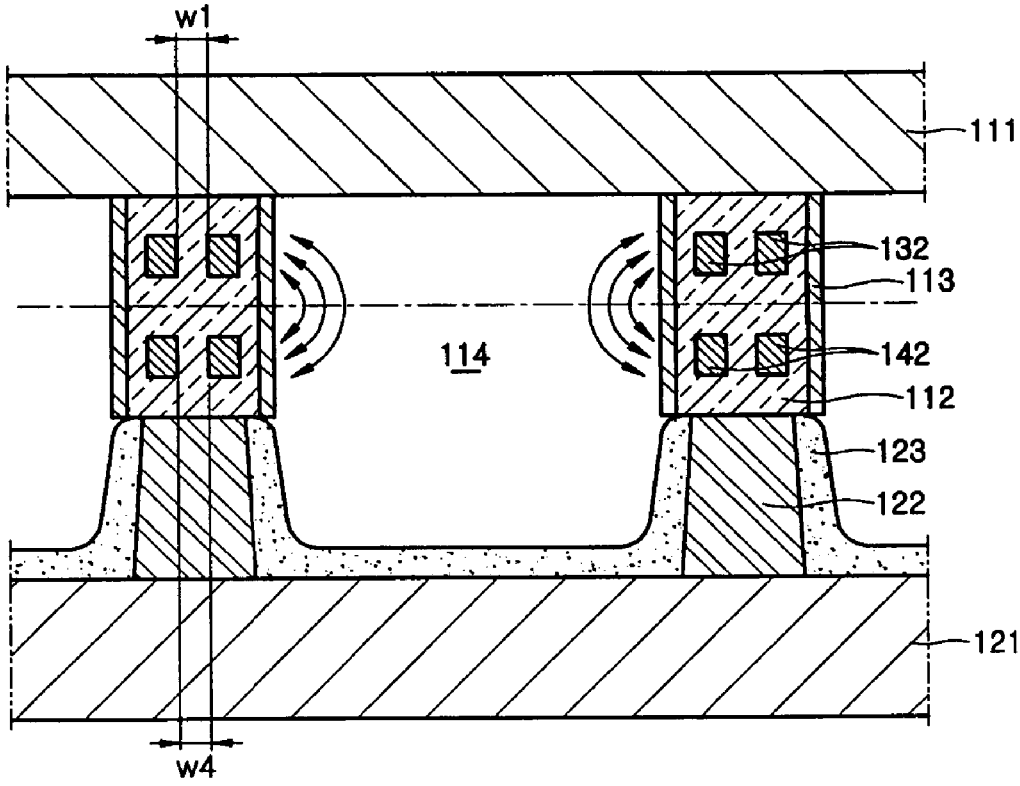
FIG. 5 is a cross-sectional view taken along line V—V of FIG. 2.

As illustrated in FIGS. 3 through 5, in the upper discharge electrodes 131 and the lower discharge electrodes 141 having the above structure, spaces between the upper discharge portion 132 and the lower discharge portion 142 located in each discharge cell 114 are vertically symmetrical with one another. Vertically symmetrical means the portions surrounding each of the discharge cells of the lower discharge electrode 141 are respectively symmetrical to the portions surrounding each of the discharge cells of the upper discharge electrode 131 with respect to the horizontal plane. Here, process errors generally occur in a process of manufacturing the upper discharge portions 132 and the lower discharge portions 142. Thus, only when the upper discharge portions 132 and the lower discharge portions 142 are manufactured within a predetermined range of errors, can it be regarded that the upper discharge portions 132 and the lower discharge portions 142 are symmetrical with one another.

As illustrated in FIG. 3, the upper discharge portions 132 and the lower discharge portions 142 are formed to a width in which they are vertically symmetrical with one another. A distance w1 between the upper discharge electrodes 131 is the same as a distance w4 between the lower discharge portions 142, which are separated from one another and between which the lower connection portions 143 are located. In addition, a distance w3 between the lower discharge electrodes 141 is the same as a distance w2 between the upper discharge portions 132, which are separated from one another and between which the upper connection portions 133 are located.

Turning now to FIG. 4, FIG. 4 is a cross section of the PDP 100 of FIG. 2 taken allong IV—IV. As shown in FIG. 4, the width and height of the upper discharge portion 132 are the same as those of the lower discharge portion 142. In addition, a distance w2 between the upper discharge portions 132 is the same as a distance w3 between the lower discharge portions 142, as described above, so that the spaces between the upper discharge portions 132 and the lower discharge portions 142 are symmetrical with one another based on a transverse axis indicated by a horizontal dotted line in FIG. 4.

Turning now to FIG. 5, FIG. 5 is a cross section of PDP 100 of FIG. 2 taken along line V—V. As illustrated in FIG. 5, the width and height of the upper discharge portion 132 are the same as the width and height respectively of the lower discharge portion 142. In addition, a distance w1 between the upper discharge portions 132 is the same as a distance w4 between the lower discharge portions 142, as described above, so that the spaces between the upper discharge portions 132 and the lower discharge portions 142 are symmetrical with one another based on a transverse axis indicated by a horizontal dotted line in FIG. 5.

Thus, any one of the upper discharge electrode 131 and the lower discharge electrode 141 having the above structure acts as an address and sustain electrode, and the other one acts as a scan and sustain electrode. For example, when the upper discharge electrode 131 acts as the address and sustain electrode and the lower discharge electrode 141 acts as the scan and sustain electrode, if an address voltage is applied to the upper discharge electrode 131 and a scan voltage is applied to the lower discharge electrode 141, an address discharge occurs in the discharge cell 114 corresponding to a cross point between the upper discharge electrode 131 and the lower discharge electrode 141. After the address discharge occurs, if a sustain voltage is alternately applied between the upper discharge electrode 131 and the lower discharge electrode 141, the charged particles move in a vertical direction and a sustain discharge occurs.

In this discharge, the spaces between the upper discharge electrodes 131 and the lower discharge electrodes 141 are symmetrical with one another based on the transverse axis so that a stable electric field can be formed. Thus, a discharge can be stably performed in a discharge mechanism in which a discharge starts from a discharge gap and occurs diffusely in all of the discharge cells 114 along a discharge electrode.

As shown in FIG. 4, the sustain discharge that occurs between the upper discharge electrodes 131 and the lower discharge electrodes 141 having the above structure is essentially concentrated on an upper side of the discharge cell 114 and on all sides by which the discharge cell 114 is defined in a vertical direction. In addition, the sustain discharge that has occurred on all sides of the discharge cell 114 occurs gradually on a central side of the discharge cell 114.

Thus, a discharge area becomes larger than that of the PDP 10 of FIG. 1. The size of an area in which a sustain discharge occurs is increased, and space charges in a discharge cell that are ordinarily not used can contribute to emission in the PDP 100. As such, the amount of plasma generated during a discharge can be increased so that low-voltage driving can be achieved. Meanwhile, ultraviolet rays are emitted from a discharge gas by the sustain discharge and a phosphor layer located in the discharge cell is excited by the ultraviolet rays so that visible light can be generated from the excited phosphor layer and a visible image can then be realized.

As described above, the PDP according to the present invention has the following advantages. First, the upper discharge electrodes and the lower discharge electrodes are vertically symmetrical with respect to one another and are both located in the first barrier rib allowing for a stable electric field to form. As such, a discharge stability can be guaranteed. Second, since electrodes and dielectric layers are not on or in the first substrate through which visible light must pass, an aperture ratio becomes higher resulting in improved visible light transmission characteristics of the first substrate. In addition, since a discharge occurs on all sides of the discharge cell, a discharge area is remarkably enlarged such that low-voltage driving can be achieved. Third, since the phosphor layer located in a lower portion of the discharge cell is separated by a large gap from a main area in which a sustain discharge occurs, phosphor layer is less apt to be ion-sputtered by the plasma resulting in a longer life-span for the PDP.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a first substrate and a second substrate arranged opposite the first substrate;

a first barrier rib arranged between the first substrate and the second substrate, defining a plurality of discharge cells together with the first and second substrates, the first barrier rib comprising a dielectric material;

a plurality of upper discharge electrodes arranged within the first barrier rib and surrounding the discharge cells, the upper discharge electrodes being separated from each other;

a plurality of lower discharge electrodes arranged within the first barrier rib, surrounding the discharge cells, being separated from each other, being separated from the upper discharge electrodes by a predetermined gap, and respectively being vertically symmetrical with respect to the upper discharge electrodes; and a phosphor layer arranged within the discharge cells.

2. The plasma display panel of claim 1, the upper discharge electrodes comprising upper discharge portions surrounding each of the discharge cells and upper connection portions connecting the upper discharge portions together, the lower discharge electrodes comprising lower discharge portions surrounding each of the discharge cells and respectively being vertically symmetrical with the upper discharge portions and lower connection portions connecting the lower discharge portions together.

3. The plasma display panel of claim 2, the upper discharge portions and the lower discharge portions, respectively, are formed to a predetermined width in the form of a rectangular band.

4. The plasma display panel of claim 2, widths of the upper connection portion and the lower connection portion are smaller than widths of the upper discharge portion and the lower discharge portion, respectively.

5. The plasma display panel of claim 2, the lower discharge electrodes extending in a direction perpendicular to a direction in which the upper discharge electrodes extend.

6. The plasma display panel of claim 5, a distance between upper discharge electrodes is the same as a distance between lower discharge portions, which are separated from one another by a predetermined gap and between which the lower connection portions are located, and a distance between the lower discharge electrodes is the same as a distance between the upper discharge portions, which are separated from one another by another predetermined gap and between which the upper connection portions are located.

7. The plasma display panel of claim 6, the upper discharge portions and the lower discharge portions, respectively, are formed to a predetermined width in the form of a rectangular band.

8. The plasma display panel of claim 6, widths of the upper connection portion and the lower connection portion are smaller than widths of the upper discharge portion and the lower discharge portion, respectively.

9. The plasma display panel of claim 1, a second barrier rib defining the discharge cells together with the first barrier rib is further formed between the first barrier rib and the second substrate, and a phosphor layer is arranged in a space defined by the second barrier rib.

10. The plasma display panel of claim 1, a side surface of the first barrier rib is covered with an MgO layer.

11. The plasma display panel of claim 1, the upper discharge electrodes and the lower discharge electrodes each comprise a conductive metal.

12. The plasma display panel of claim 1, the first barrier rib being a closed-type barrier rib partitioning off the discharge cells.

13. The plasma display panel of claim 1, the barrier rib being arranged between ones of said discharge cells.

14. The plasma display panel of claim 2, wherein each of the upper discharge portions and each of the lower discharge portions are closed loops.

15. The plasma display panel of claim 1, the upper discharge electrodes and the lower discharge electrodes being arranged to produce a discharge therebetween.

16. The plasma display panel of claim 1, the upper discharge electrodes and the lower discharge electrodes being adapted to select discharge cells for discharge by performing an address discharge between ones of the upper discharge electrodes and ones of the lower discharge electrodes, the upper and the lower discharge electrodes being further adapted to provide a sustain discharge to the discharge cells previously selected during the address discharge.

17. The plasma display panel of claim 2, the upper discharge electrodes comprising a plurality of rows of upper discharge portions connected in series together by ones of the upper connection portions.

18. The plasma display panel of claim 1, the plasma display panel being absent of address electrodes dedicated to perform an address discharge and not a sustain discharge.

19. A plasma display panel, comprising:

a first substrate and a second substrate arranged opposite the first substrate;

a plurality of barrier ribs arranged between the first substrate and the second substrate and dividing a space between the first and the second substrates into a plurality of discharge cells;

a plurality of upper discharge electrodes arranged within the plurality of barrier ribs and surrounding ones of the discharge cells, the upper discharge electrodes being separated from each other;

a plurality of lower discharge electrodes arranged within the plurality of barrier ribs, surrounding the discharge cells, being separated from each other, being separated from the upper discharge electrodes by a predetermined gap, and respectively being vertically symmetrical with respect to the upper discharge electrodes; and a phosphor layer arranged within the discharge cells.

20. The plasma display panel of claim 19, the phosphor layer being arranged in a lower portion of each discharge cell near the second substrate and the upper and the lower discharge electrodes being arranged in an upper portion of the plurality of barrier ribs near the first substrate.

21. The plasma display panel of claim 20, the lower discharge electrodes being separated from the phosphor layer by a first gap, the upper discharge electrodes being arranged closer to the first substrate than the lower discharge electrodes.

22. The plasma display panel of claim 19, the first substrate not being in contact with any electrodes.

23. The plasma display panel of claim 19, the plurality of barrier ribs comprising a dielectric material, the plurality of barrier ribs being coated with a MgO protective layer.

24. The plasma display of claim 19, the plurality of barrier ribs comprising a material selected from the group consisting of PbO, $B_2O_3$ and $SiO_2$.

25. The plasma display panel of claim 19, the upper discharge electrodes and the lower discharge electrodes each being absent of indium tin oxide and/or indium zinc oxide.

26. The plasma display panel of claim 19, the plasma display panel being absent of any electrodes arranged on any of the first and the second substrates.

27. The plasma display panel of claim 19, the upper discharge electrodes and the lower discharge electrodes both being adapted to together produce both an address discharge and a subsequent sustain discharge.

28. The plasma display panel of claim 19, the upper discharge electrodes and the lower discharge electrodes being adapted to produce a sustain discharge as well as being adapted to select specific discharge cells for the sustain discharge by producing an address discharge.

29. The plasma display panel of claim 19, the lower discharge electrodes comprising a plurality of rows of electrodes, each row being electrically isolated from other rows, each row surrounding individual discharge cells in a row.

* * * * *